United States Patent [19]

Sigetich et al.

[11] 4,428,159

[45] Jan. 31, 1984

[54] PORTABLE, DIRECT DRIVE ABRASIVE SAW

[76] Inventors: John D. Sigetich, 2127 Gladiator, Fenton, Mo. 63026; Karl B. Schweickhardt, 23 W. Meadow, St. Louis, Mo. 63011

[21] Appl. No.: 287,931

[22] Filed: Jul. 29, 1981

[51] Int. Cl.[3] ..... B24B 7/02

[52] U.S. Cl. ..... 51/92 R; 51/99; 125/13 R

[58] Field of Search ..... 51/92 R, 99; 83/435.1; 125/13 R, 14

[56] References Cited

U.S. PATENT DOCUMENTS

| | | | |
|---|---|---|---|
| 2,187,299 | 1/1940 | Burkhardt | 125/13 R |
| 2,213,011 | 8/1940 | Martin | 51/92 R |
| 2,492,684 | 12/1949 | Coates | 51/92 R |
| 2,557,251 | 6/1951 | Baker et al. | 125/13 R |
| 3,635,206 | 1/1972 | Harclerode | 125/13 R |

OTHER PUBLICATIONS

Target Masonary/Refractory Saws, 6 pages, Date unknown.

*Primary Examiner*—Harold D. Whitehead

*Attorney, Agent, or Firm*—Polster, Polster and Lucchesi

[57] ABSTRACT

A portable, direct drive abrasive saw for cutting ceramic tile, bricks, masonry blocks, metal, refractory, or other work comprising a base pan of an electrically insulative, synthetic resin material with the pan constituting a coolant reservoir. A frame is secured to the pan and the frame includes a pair of generally parallel, spaced rails extending horizontally of the pan and a saw support fixture. A unitary, direct drive abrasive saw is fixedly mounted from the saw support fixture in a cutting position. The saw includes an electric motor, a rotary abrasive saw blade with the rotary axis of the saw blade being disposed within a plane generally perpendicular to the rails and a drive for directly interconnecting the motor and the saw blade. A table is provided reciprocably mounted on the rails for supporting the work to be cut and the table is movable toward and away from the saw blade from a retracted position in which the table and the work thereon is clear of the saw blade and a cutting position in which the saw blade cuts through the work as the latter is moved past the saw blade. The saw further includes a coolant pump for circulating coolant from within the pan over the saw blade as the work is cut.

7 Claims, 9 Drawing Figures

PORTABLE, DIRECT DRIVE ABRASIVE SAW

BACKGROUND OF THE INVENTION

This invention relates to a portable, direct drive abrasive saw particularly well suited for cutting ceramic floor tile, bricks, or other masonry, metal, or refractory materials.

During the installation of ceramic flooring or roof tile, it is often necessary for the tile installer to specially trim the tile pieces to precisely fit along walls, around pipes, door moldings, and other protuberances. While, in some instances, it is acceptable tile installation practice to score and to break the tile along the score line, this oftentimes results in uneven or jagged edges for the tile. In recent years, tile installers, especially those installing relatively expensive, glazed floor tiles, have utilized rotary abrasive saws to precisely cut the tile to a desired dimension thereby to result in a neat appearance for the tile and also to prevent the inadvertent breakage of the tile along dimension lines not desired.

Typically, tile cutting saws utilize a rotary abrasive blade mounted on an arbor shaft supported by anti-friction roller bearings. The support for the bearings was in turn supported on a frame and a frictional horsepower induction electric motor was mounted on the frame remote from the arbor shaft and the saw blade. The motor drove the shaft by means of a V-belt and pulley arrangement. These fractional horsepower induction motors were in and of themselves relatively heavy. For example, a one horsepower 115 volt motor may weigh 23 pounds or more. In addition, the application or mounting fixture for the fractional horsepower motor was, of necessity, made of relatively heavy gauge metal and the frame for supporting the arbor shaft and bearings support assemblies was heavy. Still further, the V-belt and pulley drive necessitated that it be enclosed within a guard.

Because of the use of the fractional horsepower electric motor and its belt drive, and the arbor shaft and the rotary abrasive saw blade were fixed in horizontal position. Thus, it was not possible to make bevel cuts on pieces of tile or other work. Still further, the size and weight of known prior art tile saws was such that the saws were not portable. In practice, with the reservoir of the prior art tile cutting machines filled with water to serve as a coolant circulated over the abrasive blade while cutting the tile, the prior art tile cutting saws weighed in excess of 80 pounds.

Thus, a tile setter, upon installing a tile floor, would position the tile cutting saw at a particular location in the room and each time he had to trim a tile, it was necessary for him to make the desired measurements for the particular tile, to leave his work location, cut the tile to the desired dimensions, and return to his working position for installation of the tile. On installing roofing tiles, the tile saw was set up on the ground and it was necessary for the tile setter to take the dimensions for the intended tile, to climb down a ladder from the roof and cut the tile to the desired dimensions, and to then climb the ladder for installation of the tile.

Still further, the size and weight of these prior art saws made it difficult at the end of the day for the tile setter to properly secure the tile cutting saw on the jobsite or to put them in his truck or car, and thus made them vulnerable to theft.

SUMMARY OF THE INVENTION

Among the several objects and features of the present invention may be noted the provision of a portable, direct drive diamond or abrasive saw, particularly adapted for cutting ceramic tile, bricks, masonry blocks, metal, refractories, or other work in which the saw was readily portable to the actual jobsite;

The provision of such a portable abrasive saw which is of lightweight and yet rugged construction;

The provision of such a portable abrasive saw which may be readily adjusted to accommodate cutting work at an angle or a bevel;

The provision of such a portable abrasive saw which eliminates the necessity of indirect belt and pulley drives;

The provision of such a portable abrasive saw which, at the end of a work day, may be readily removed from the jobsite and stored in a secure place thereby to lessen the possibility of theft of the saw; and The provision of such a saw which is relatively easy and economical to manufacture, which is reliable in operation, which is easy to service, and which has a relatively long service life.

Briefly stated, a portable, direct drive abrasive saw of the present invention is intended for cutting materials such as ceramic tile, bricks, masonry blocks, metal, refractories, and other work. The saw of this invention comprises a base pan of electrically insulated, synthetic resin material with the pan constituting a coolant reservoir. A frame is secured to the pan and the frame includes a pair of generally parallel, spaced rails extending horizontally of the pan and a saw support fixture. A unitary direct drive abrasive saw assembly is fixedly mounted from the saw support fixture in a cutting position. The saw includes an electric motor, a rotary abrasive saw blade with the rotary axis of the saw blade being disposed within a plane generally perpendicular to the rails of the frame and further having means for directly interconnecting the motor and the saw blades for rotary driving of the saw blade. A table is reciprocably mounted on the rails and supports the work to be cut for being moved toward and away from the saw blade from a retracted position in which the table and the work thereon is clear of the saw blade and a cutting position in which the saw blade cuts through the work as the latter is moved past the saw blade. The saw further includes a coolant pump for circulating coolant from within the reservoir to the saw blade as the work is being cut.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
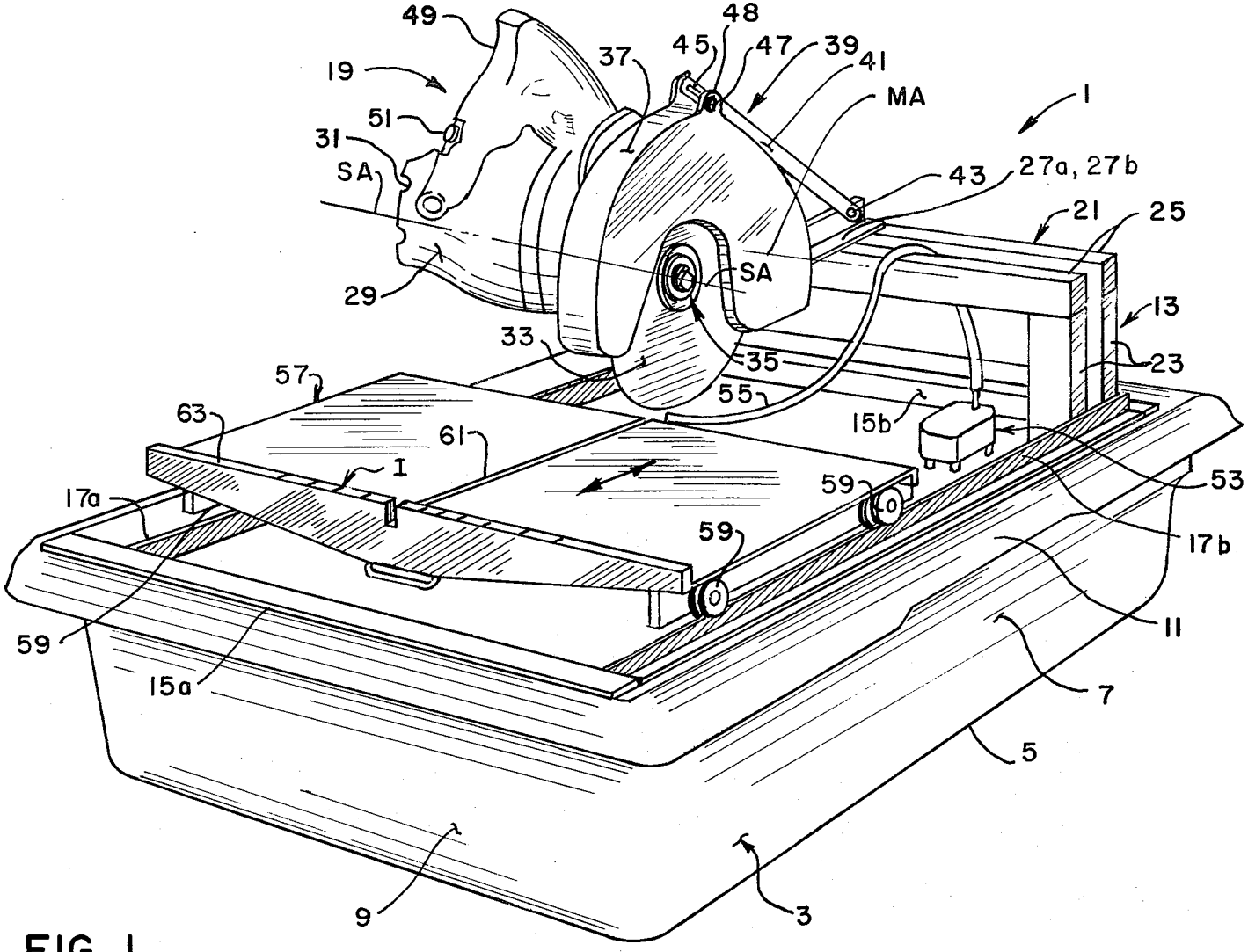
FIG. 1 is a three-quarters perspective view of a portable abrasive saw of the present invention with its work support table in its retracted position.
Figure 2:
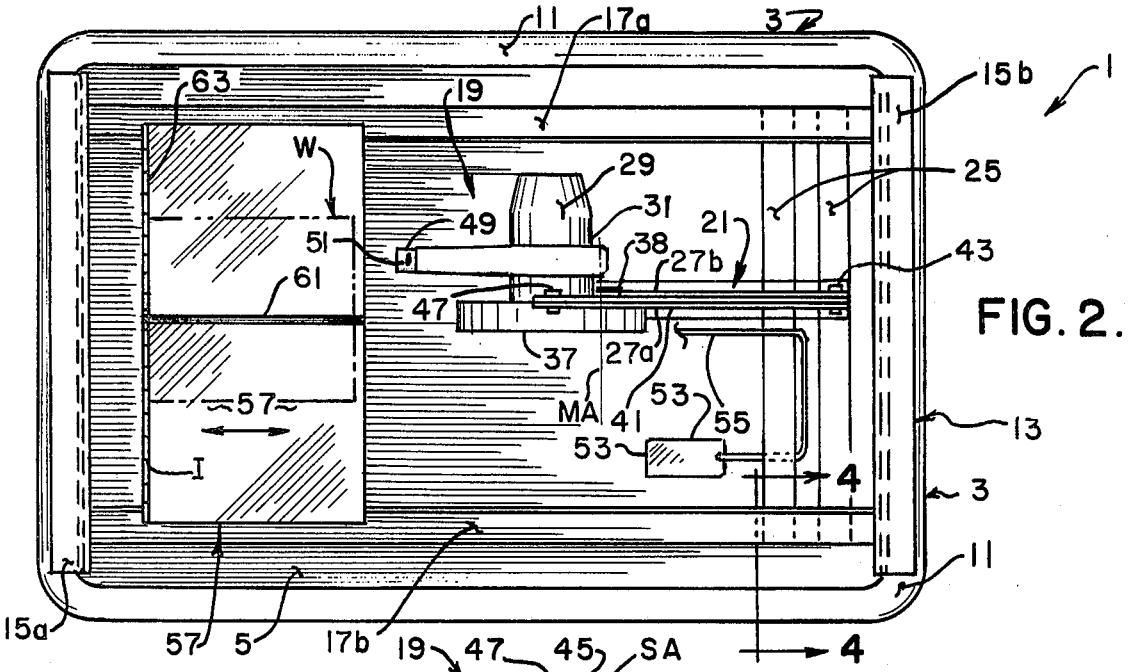
FIG. 2 is a top plan view of the portable abrasive saw shown in FIG. 1.
Figure 3:
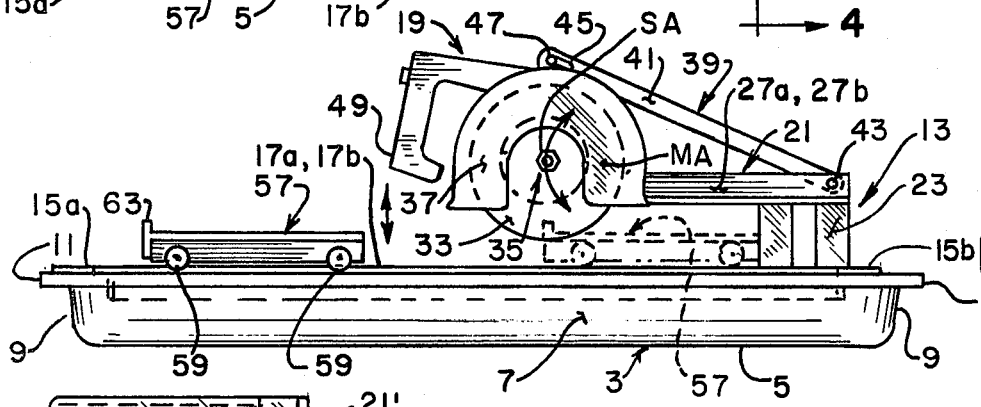
FIG. 3 is a right side elevational view of the saw, as it is viewed in FIG. 1, with the table shown in solid lines in its retracted position and shown in phantom lines in its cutting position.

Referring now to the drawings, and particularly to FIGS. 1-3, a portable, direct drive abrasive or diamond saw of the present invention is generally indicated by reference character 1. This abrasive saw is particularly well suited for a craftsman, such as a tile setter, a brick layer or the like to cut ceramic tiles, bricks, masonry blocks, metal, refractory materials, or other similar work on location at the jobsite without the necessity of leaving the jobsite to go to the location of the saw. For example, in the laying of ceramic floor tile, the saw of the present invention may be readily and easily moved along the floor by the tile setter so as to be proximate his position so that when it becomes necessary to cut a tile to fit in a particular location, the tile setter may readily and quickly make the measurements, cut the tile to the desired measurements, and lay the tile without the necessity of leaving his work position. This dramatically increases the speed at which he can lay tile and hence reduces the amount of labor required.

Specifically, the portable saw of the present invention is shown to include a base pan, as generally indicated at 3, preferably of a suitable electrically insulative, high strength, wear resistant synthetic resin material, such as a high density polyethylene or other high strength impact resistant plastic. The base pan includes a bottom wall 5 (see (FIG. 2), opposite sidewalls 7 and end walls 9. A rolled over lip 11 extends around the upper edges of the side and end walls thus providing a convenient fingerhold for carrying the base pan and also providing a structural stiffener for rigidizing the base pan. It will be understood that the base pan thus constitutes a reservoir for holding a quantity of coolant (e.g., water) which, as will be hereinafter explained in detail, is circulated over the abrasive saw blade for cooling the saw blade and the work while the work is cut by the portable saw of the present invention.

For example, base pan 3 of the present invention may have an overall length of approximately 25½ inches, a width of approximately 18¾ inches and a depth of approximately 6 inches. Under normal operating conditions, the coolant reservoir will normally be filled with approximately 7 gallons of water.

Further in accordance with this invention, a frame, as generally indicated at 13, is mounted within base pan 3 and is secured thereto. The frame includes a pair of opposite end members 15*a*, 15*b* formed of angle iron or the like disposed with the upper flange of the angle irons extending outwardly away from one another and with the other legs of the angles extending downwardly and adapted to be positioned on the inside of end walls 9. The underface of the upper flanges of these end members bear on the upper edge of lip 11 and thus support the frame within the base pan. Suitable fastener means, such as bolts or screws (not shown), may be inserted through the upper flanges of end members 15*a*, 15*b* thereby to secure frame 13 to the base pan.

Frame 13 is shown to further comprise a pair of rails 17*a*, 17*b* spaced apart from one another and extending longitudinally the length of base pan 3 between opposite end members 15*a*, 15*b*. Again, rails 17*a*, 17*b* are shown to be of angle iron construction oriented with one flange extending vertically and with a horizontal flange extending outwardly toward the inside faces of adjacent sidewalls 7. The upper edges of the vertical flange of these rail members constitute track or rail surfaces for purposes as will appear.

Further, portable saw 1 of the present invention includes a unitary, direct drive, rotary saw assembly, as generally indicated at 19, fixedly positioned by frame 13. The frame includes a saw support, as generally indicated at 21, at the end of the frame adjacent end member 15*b*. Saw support 21 is shown to comprise a pair of vertical supports 23 spaced apart from one another and at each side of the frame secured (e.g., welded) to respective rail members 17*a*, 17*b* and extending vertically above the upper edge of the vertical flange of the rail members. Horizontal support members 25 extend transversely of the frame from the upper end of one vertical support member 23 to the upper end of a corresponding vertical support member on the opposite side of the frame. Again, vertical members 23 and horizontal members 25 are of angle iron construction and the horizontal transverse members 25 are oriented so as to have their upper flanges in generally horizontal position and vertical flanges extending downwardly with the horizontal upper flanges constituting a generally planar mounting surface.

A pair of cantilever arms 27*a*, 27*b* is mounted on the upper faces of horizontal arms 25 so as to extend in cantilever fashison generally horizontally inwardly of the frame from the saw support 21 out over the center portion of the frame above base wall 5 of base pan 3. These cantilever arms 27*a*, 27*b* are shown to be a pair spaced apart angle iron members secured to the horizontal members 25 in back-to-back relation.

The unitary direct drive saw assembly 19 is shown preferably to comprise a lightweight saw assembly, such as a hand held circular power saw, including a housing 29. An induction electric motor, as indicated at 31, is mounted within housing 29 so as to directly drive an abrasive saw blade 33 about a saw axis, as indicated at SA in FIG. 1, for cutting a work piece W (as shown in phantom in FIG. 2). As is conventional with saw unit such 19, a suitable direct drive gear train (not shown) is interposed between the rotor shaft (also not shown) of motor 31 and the drive shaft for saw blade 33. Those skilled in the art will recognize that any one of a variety of commercially available, hand held power saws modified in accordance with the instant disclosure may be utilized for the unitary, direct drive saw 19, as illustrated in FIG. 1. For example, a model 534 circular saw, manufactured by the Skil Corporation of Chicago, Ill. may be utilized as the unitary saw assembly 19. As indicated at 35, a removable saw blade mounting arbor and locking bolt assembly is provided for readily permitting the removal of one saw blade and the installation of another on the drive shaft of the saw.

Saw 19 is provided with a saw blade guard 37 at least partially enclosing the saw blade and protecting users of the saw from inadvertently touching the rotating saw blade 33 while in operation. Saw 19 is pivotally mounted on cantilever arms 27 by means of a mounting bolt 38 (see FIG. 2) inserted through a boss provided on the housing 31 of the saw and extending through corresponding holes in the cantilever saw support arms 27*a*, 27*b*. In this manner, the saw 19 is rotatable about a mounting axis MA extending longitudinally through the center of the bolt whereby the saw axis SA extending through the rotary axis of saw blade 13 pivots (as shown by the arcuate arrow in FIG. 3) relative to axis MA and thus is eccetrically mounted with respect to frame 13 for permitting vertical adjustment of the saw blade relative to the frame and the table.

Further, saw 17 is held in a desired adjusted position or height by means of a locking arrangement, as generally indicated at 39, including a strap 41 pivotally secured at its outer end to cantilever arms 27 by a pivot bolt 43. The strap 41 extends rearwardly and has an elongate slot 45 in its rear end portion. A bolt 47 inserted through a hole in a boss 48 on the upper surface of guard 3. Bolt 47 is received in the elongate slot 45 and, upon tightening bolt 47, the guard assembly 37 and hence the saw assembly 19 is clampingly held in fixed position relative to bar 41 thus locking the saw assembly in a desired vertical position relative to the frame.

In accordance with this invention, saw assembly 19 is suitably modified to electrically ground all parts of the saw (e.g., the motor, the guard 37, and other metal components) so as to reduce the potential of electrical shock hazard to the user. Saw housing 29 further includes a handle 49 and an on/off toggle switch 51 is provided on the handle in a convenient location for operation by the user to energize and de-energize motor 31 and pump 53 at the same time.

An electrically operable, submersible pump, as generally indicated at 53, is located within base pan 3 for circulating coolant within the base pan to the rotating saw blade via coolant lines 55 leading from the pump to outlet nozzles on saw blade guard 37. For example, a model N300A submersible pump commercially available from the Beckett Company of Dallas, Tex. may be utilized for coolant pump 53. In accordance with this invention, the motor for coolant pump 53 is adequately grounded so as to reduce electrical shock hazard.

Further in accordance with this invention, a work support table 57 is rollingly mounted on rail members 17*a*, 17*b* for translation in horizontal direction between a retracted position (as shown in solid lines in FIGS. 1–3) in which the work W supported on the upper face of table 57 and the table is clear of the cutting surfaces of saw blade 33 and a cutting position in which the saw blade cuttingly engages the work. The table is movable to its full cutting position (shown in phantom in FIG. 3) such that the saw blade 33 may fully cut through work W supported on the table. Table 57 is rollingly supported on the upper edges of the vertically extending flanges of rail members 17*a*, 17*b* by means of four steel rollers 59. A center groove 61 is provided in the work table extending down below the work supporting upper surface of the table for accommodating the lower pheriphery of saw blade 33 as the work table is moved from its retracted position to its full cutting position and as the saw blade cuts through the work supported on the table. A rear flange 63 is provided at the rear of the table with the flange extending above the height of the work supporting surface whereby the work W to be cut (e.g., a ceramic tile) may be properly aligned and held square with respect to the table so as to insure a true and square cut by saw blade 33 as the work support table is manually moved from its retracted to its cutting position. In addition, indicia I (see FIGS. 1 and 2) may be provided on the upper surface of flange 63 so that the dimensions of the work to be cut may be readily measured by referring to the indicia.

It will be further understood that table 57 may be so mounted on rails 17*a*, 17*b* that the table cannot be lifted clear of the rails and is thus retained on the rails if a tile setter were to transport (carry) the saw assembly 1 from one site to another by grasping handle 49. For example, J-bolts (not shown) may extend down from the undersurface of the table to be cooperable with the lower surface of rail 17*a*, 17*b* to prevent the table from being inadvertently removed therefrom. If it is desired to remove the table from the rails, the J-members may be rotated clear of the rails and the table may be lifted therefrom.

A portable power saw 1 of the present invention, constructed in the manner described above, has a weight of approximately 32 pounds. Even when it contains a suitable supply of coolant in the reservoir (e.g., 7 gallons), the total weight of the saw assembly plus the coolant is such that a workman, such as a tile setter, may readily move the tile saw from place-to-place as he progresses with his work. In this manner, the tile saw is kept in close proximity to the worker and he may readily cut pieces of tile or other work to a predetermined size directly at the jobsite without the necessity of leaving the jobsite. This is particularly important to such craftsmen such as roof tile setters and it will be appreciated that the saw 1 of the present invention may be taken directly up on the roof or scaffolding adjacent the roof so as to eliminate the necessity of the tile setter from having to climb down a ladder from the roof to cut tile to a specified size.

The saw motor 31 and saw assembly 19 in the embodiment described above produces approximately $1\frac{1}{2}$ to 3 horsepower and rotates the saw blade 33 under no load at approximately 5,000 rpm. As shown in FIGS. 1–3, the diameter of the saw blade is approximately 6 inches. However, it will be appreciated by those skilled in the art, that the saw described above may be readily modified so as to accept larger diameter abrasive saw blades. In order to accomplish this, it may be necessary to increase the height of vertical members 23 so as to permit a larger diameter saw blade to cut work supported on the work surface of table 57. Further, while saw blade 33 is described generally as an abrasive saw blade, a diamond abrasive saw blade, such as is commercially available from Great Eagle Enterprises of St. Louis, Mo. under the trademark EVERSHARP may be preferred.

Referring now to FIGS. 4–7, a second embodiment of the power saw 1 of the present invention is illustrated with this second embodiment being indicated generally by 1'. While saw assembly 1' is generally similar to the power saw assembly 1 heretofore described, certain key differences will be pointed out. However, corresponding parts of power saw 1' having a corresponding function to parts heretofore described in regard to saw 1 are indicated by corresponding reference characters and are "primed".

Figure 4:
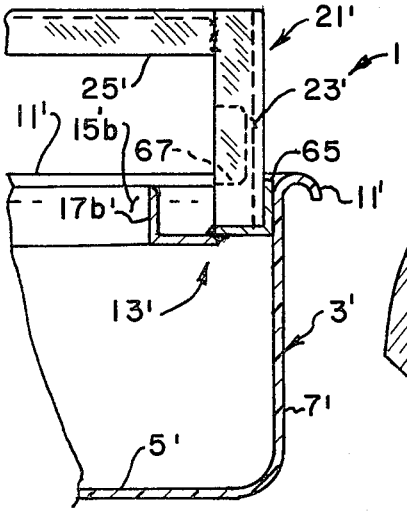
FIG. 4 is an enlarged cross-sectional view taken along line 4—4 of FIG. 2 illustrating a different arrangement for the frame illustrated in FIG. 2 permitting a wider work support table to pass between the saw support structure.

In FIG. 4, frame 13' is shown to be modified so that the spacing between uprights 23' is somewhat greater than the spacing between vertical or upright supports 23 in saw 1 thereby to permit a wider table (not shown in FIG. 4) to be utilized in conjunction with the same base pan 3 or to permit wider work pieces (e.g., a 12 inch tile) to be cut by the saw without interference from the vertical members 23'. Specifically, frame 13' includes an additional longitudinal angle iron member 65 welded to rail members 17*a*' and 17*b*' in the manner shown in FIG. 4. Specifically, member 65 has a lower horizontal flange which extends inwardly from the innerface of sidewall 7' of base pan 3' and the corresponding rail member 17*a*, 17*b*' is welded thereto with the vertical flange of the rail member constituting a rail on which rollers 59' for table 57' are mounted. Vertical members 23' are secured (e.g., welded) to the inside surfaces of the horizontal and vertical flanges of the additional longitudinal frame member 65 and thus are spaced further outboard of the rails than in frame 13 shown in FIG. 1 and thus permit a wider table or a wider work piece to move longitudinally on the rails beyond the position of the vertical members 23'. Additionally, an optional notch, as indicated in dotted lines at 67 in FIG. 4, may be provided in vertical member 23' to provide additional clearance for the work or the table.

Figure 5:
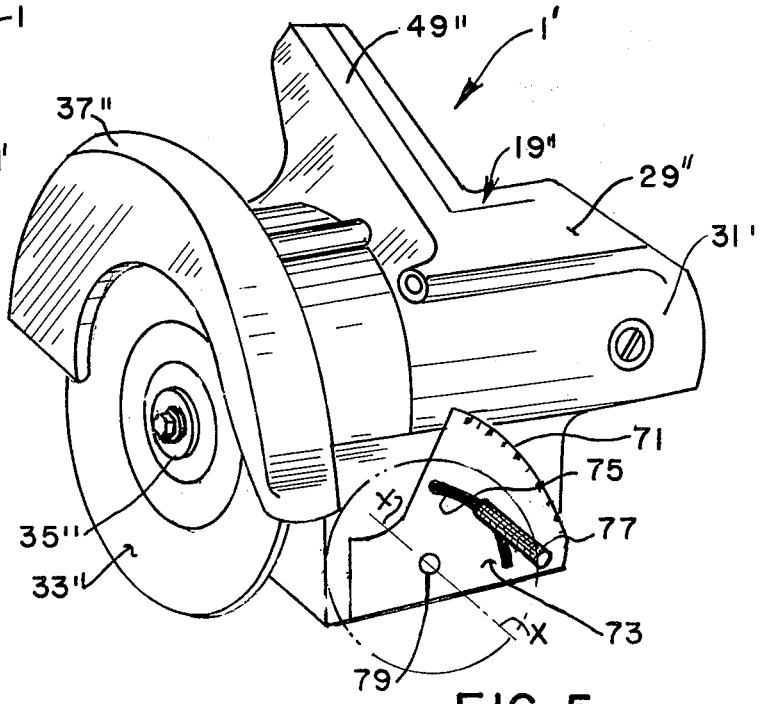
FIG. 5 is a front perspective view of another embodiment of a unitary, direct drive rotary abrasive saw used in conjunction with the portable saw of the present invention in which the unitary saw is selectively rotatable (at least to a limited degree) about a horizontal axis extending perpendicular to the rotary axis of the saw blade and being selectively lockable in any desired position thereby to permit the saw to bevel cut work positioned on the work support table.
Figure 6:
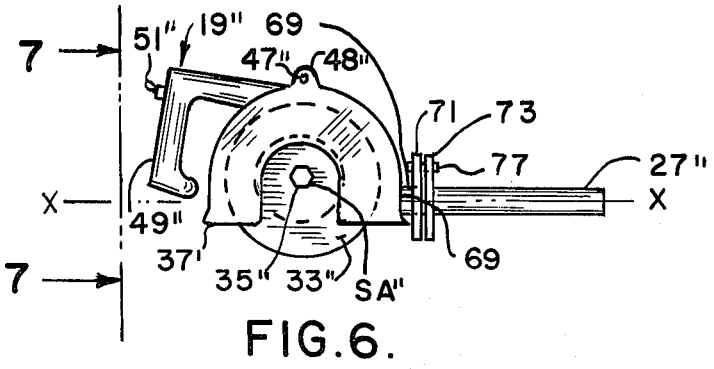
FIG. 6 is a right side elevational view of the unitary saw shown in FIG. 5.
Figure 7:
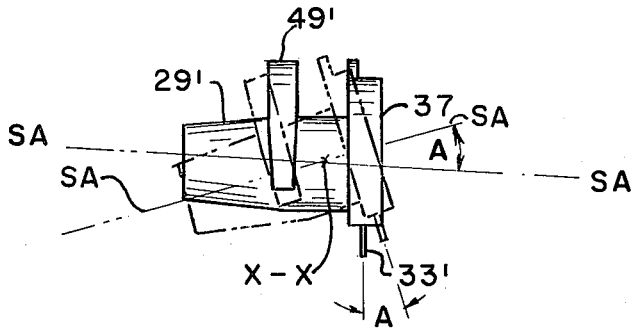
FIG. 7 is an end elevational view taken along line 7—7 of FIG. 6 illustrating the saw at an angle with the abrasive blade positioned to cut a work piece supported on the table at an angle or bevel.

Further in accordance with this invention, saw assembly 19" may be mounted on saw support 21" in such manner as to permit the saw assembly 19" to be rotated about a generally horizontal axis, as indicated at X—X, thereby to incline the blade of the plane of blade 33" relative to the vertical (as shown in FIG. 7) and to enable the blade to cut the work at an angle A (i.e., to produce a bevel cut on the work). Specifically, the means for mounting saw assembly 19" for selected rotation about horizontal axis X—X comprises an extension member 69 (see FIG. 6) cantilevered out from housing 31" and having a plate 71 rigidly mounted thereon. Plate 71 is in face-to-face engagement with a corresponding plate 73 rigidly mounted on the outer end of cantilever arms 27". As best shown in FIG. 5, plate 71 is provided with an arcuate slot 75 generally concentric with the axis X—X and a selectively actuable clamping fastener 77 (see FIG. 6) is inserted through plate 73 and is received in arcuate slot 75. Additionally, a pivot pin 79 is provided through plates 71 and 73 coaxial with axis X—X. Thus, upon loosening locking screw 77, saw assembly 19" may be rotated about pin 79 (i.e., rotated about axis X—X) within a limited range (as determined by the arcuate length of slot 75) to assume a desired angular position (as shown in FIG. 7). With the saw assembly in its desired angular position, locking screw 77 then may be tightened to clampingly lock plates 71 and 73 in face-to-face engagement and thus lock the saw in its desired angle position so as to form bevel cuts on the work W supported on table 57".

Figure 8:
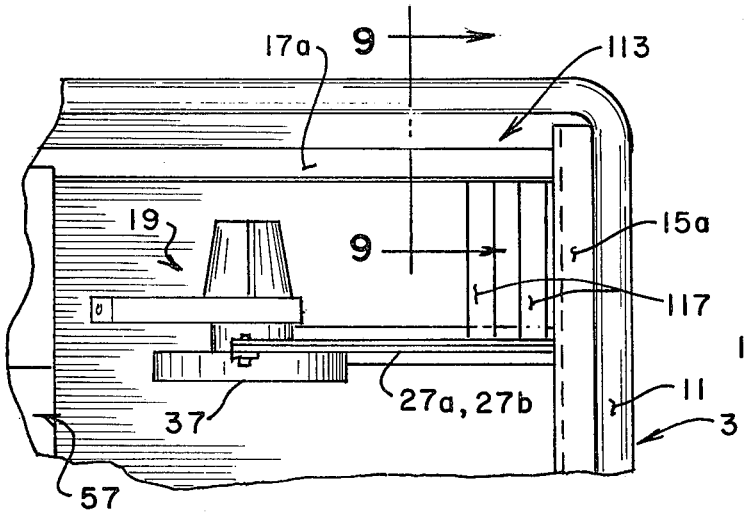
FIG. 8 is a partial top plan view of still another embodiment of the saw of this invention illustrating a saw support cantilevered from one side (the left side) of the frame.
Figure 9:
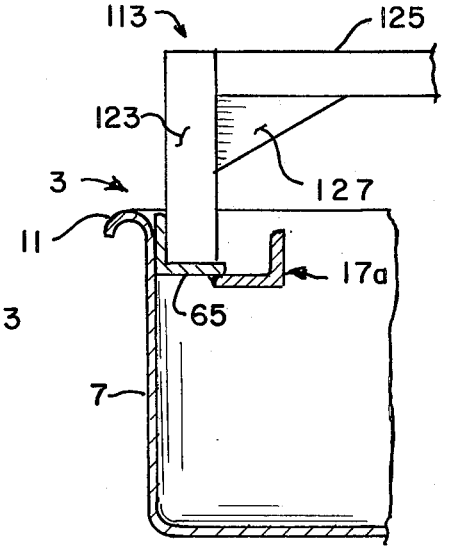
FIG. 9 is a vertical cross-sectional view taken on line 9—9 of FIG. 8.

Referring now to FIGS. 8 and 9, a modification of frame is shown, this modified frame being generally indicated by reference character 113. The parts of the saw heretofore described retained identical reference characters. More specifically, frame 113 includes a pair upright member 123 rigidly secured to and extending upwardly from one side of the frame, for example, from rail 117*a*. A pair of horizontal transverse support members 125 are cantilever secured (welded) to the upper ends of vertical members 123 at one side (e.g., the left side) of frame 13. Saw support arms 27*a*, 27*b* are in turn cantilever supported from the outer ends of support members 117. Saw 19 is supported from arms 27*a*, 27*b* in a manner similar to saw 19 above-described in regard to FIGS. 1–3. By cantilevering the saw support from one side of frame 113, a long work piece W may be positioned on the table so as to extend out beyond the rail 17*a* or 17*b* opposite vertical members 123. A gusset 127 may be welded between upright 123 and horizontal members 125 thereby to support the horizontal members in cantilever position.

Those skilled in the art will recognize that the saw of the present invention may be utilized to cut a variety of materials in addition to ceramic tile, such as bricks, masonry blocks, refractory materials, metal, and the like.

In view of the above, it will be seen that the several objects and features of this invention are achieved and other advantageous results obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A portable, direct drive abrasive saw for cutting ceramic tile, bricks, masonry blocks, metal, refractory material, or other similar work comprising a base pan constituting a coolant reservoir, a frame secured to said pan, said frame including a pair of generally parallel, spaced rails extending horizontally of the pan when said saw is in its normal operating position, a saw support, a unitary, direct drive abrasive saw mounted on said saw support in a cutting position, said saw including an electric motor haing an axis of rotation, a rotary abrasive saw blade with the rotary axis of said saw blade being coaxial with the rotary axis of said motor, means for directly interconnecting said motor to said blade for rotatably driving said blade, a table reciprocably mounted on said rails supporting said work to be cut and being movable in a generally horizontal direction toward and away from said saw blade from a retracted position in which said table and the work thereon is clear of said saw blade and a cutting position in which said saw blade cuts through said work as the latter is moved past said saw blade, and a coolant pump for circulating coolant from within said base pan to said saw blade as the latter cuts through the work, said saw support including at least one horizontal frame member extending transversely of said rails above the level thereof at one end of said frame, said at least one horizontal frame member being rigidly secured relative to said frame, and means cantilevered from said at least horizontal frame member and extending from one end of the frame back toward the other end thereof in a direction generally parallel to said rails for mounting said unitary direct drive abrasive saw, said direct drive saw including said motor and said abrasive saw blade being pivotably mounted on the free end of said cantilevered support means for rotation about a second axis generally parallel to and eccentrically offset from the rotary axis of said saw blade thereby to selectively permit the raising and lowering of said saw blade relative to said table, and means for locking said saw at a desired height.

2. A portable saw as set forth in claim 1 wherein said locking means comprises an elongate bar extending generally perpendicular to said eccentric axis of said saw and being pinned at one of its ends to said frame and being in engagement with said saw at its other end at a point remote from said eccentric axis with an elongate slot at one end of said bar with a threaded fastener received in said elongate slot for clamping sdaid bar in a desired position relative to said saw thereby to hold said saw in a desired sawing position.

3. In a portable saw as set forth in claim 1 wherein said frame further comprises end members at each end of said frame engageable with said base pan so as to support said frame relative to said base pan, said saw support being at one end of said frame and comprising at least one vertical member secured to and extending above the level of said rails at each side of the frame, at least one horizontal member secured to the upper end of said at least one vertical member and extending transversely of the frame, and at least one cantilever member secured to said at least one horizontal member and extending perpendicular therefrom in a direction generally parallel to said rails above the level of said rails for supporting said saw.

4. A portable saw as set forth in claim 3 wherein said at least one vertical member is spaced outboard of said rails thereby to permit movement of said table or work supported on said table past said at least one vertical member as said table moves fully toward its cutting position.

5. A portable saw as set forth in claim 1 wherein said saw is a hand operated circular saw including said motor, said saw blade, and said drive means.

6. A portable saw as set forth in claim 1 wherein said motor, saw blade, and said motor, saw, and coolant pump are electrically grounded.

7. A portable saw for cutting ceramic tile, bricks, masonry blocks, metal, refractory material, or other similar work comprising a base pan constituting a coolant reservoir, a frame secured to said pan, said frame including a pair of generally parallel, spaced rails extending horizontally of the pan and a saw support, a unitary, direct drive abrasive saw mounted from said saw support in a cutting position, said direct drive saw including an electric motor having an axis of rotation, a rotary abrasive saw blade with the rotary axis of said saw blade being coaxial with the rotary axis of said motor, and means for directly interconnecting said motor to said blade for rotatably driving said blade, a table reciprocably mounted on said rails supporting said work to be cut and being movable in a generally horizontal direction toward and away from said saw blade from a retracted position in which said table and the work thereon is clear of said saw blade and a cutting position in which said saw blade cuts through said work as the latter is moved past said saw blade, and a coolant pump for circulating coolant from within said base pan to said saw blade as the latter cuts through the work, said saw support including at least one horizontal frame member extending transversely of said rails above the level thereof at one end of said frame, said at least one horizontal frame member being rigidly secured relative to said frame, and means cantilevered from said at least horizontal frame member and extending from one end of the frame back towardthe other end thereof in a direction generally parallel to said rails for mounting said unitary direct drive abrasive saw, said direct drive saw including said motor and said abrasive saw blade being pivotably mounted on the free end of said cantilevered support means for rotation about a second axis generally parallel to and eccentrically offset from the rotary axis of said saw blade thereby to selectively permit the raising and lowering of said saw blade relative to said table, and means for locking said saw at a desired height wherein said saw support fixture further includes means for permitting rotation of said saw together with said blade about a horizontal axis generally parallel to said rails and means for locking said saw in a desired angle position with said saw blade oriented out of a vertical plane whereby to permit the work to be cut on a bevel.

* * * * *